US012669028B2

(12) United States Patent
Stronach et al.

(10) Patent No.: US 12,669,028 B2
(45) Date of Patent: Jun. 30, 2026

(54) WELLBORE CLEANING TOOLS

(71) Applicant: Wellbore Integrity Solutions LLC, Houston, TX (US)

(72) Inventors: Graham Stronach, Spring, TX (US); Shantanu N. Swadi, Cypress, TX (US); David Johnson, Houston, TX (US); David Moyer, Houston, TX (US); Mitul Patel, Houston, TX (US); Delaney Olstad, Houston, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 0 days.

(21) Appl. No.: 18/620,072

(22) Filed: Mar. 28, 2024

(65) Prior Publication Data

US 2025/0137355 A1 May 1, 2025

Related U.S. Application Data

(60) Provisional application No. 63/594,893, filed on Oct. 31, 2023.

(51) Int. Cl.

| | |
|---|---|
| ***E21B 31/06*** | (2006.01) |
| ***E21B 17/10*** | (2006.01) |
| ***E21B 37/00*** | (2006.01) |

(52) U.S. Cl.

CPC ..... *E21B 31/06* (2013.01); *E21B 37/00* (2013.01); *E21B 17/1057* (2013.01); *E21B 17/1064* (2013.01)

(58) Field of Classification Search

CPC ..... E21B 37/00; E21B 31/06; E21B 17/1057; E21B 17/1064

See application file for complete search history.

(56) References Cited

U.S. PATENT DOCUMENTS

| | | | | |
|---|---|---|---|---|
| 3,361,493 | A * | 1/1968 | Melton | E21B 17/1064 384/547 |
| 4,441,565 | A * | 4/1984 | Liljekvist | E21B 17/00 175/325.3 |
| H1192 | H * | 6/1993 | Keller | E21B 17/1028 166/241.6 |
| 5,901,798 | A * | 5/1999 | Herrera | E21B 17/1064 166/241.3 |
| 6,109,374 | A * | 8/2000 | Burca | E21B 17/1057 175/324 |
| 7,219,724 | B2 * | 5/2007 | Theriot, Sr. | E21B 37/00 166/99 |
| 7,753,114 | B1 * | 7/2010 | Penisson | E21B 37/00 166/99 |
| 11,891,870 | B2 * | 2/2024 | Maher | H01F 7/0252 |
| 2005/0274524 | A1 * | 12/2005 | Silguero | E21B 37/00 166/66.5 |
| 2006/0011346 | A1 * | 1/2006 | Theriot | E21B 21/065 166/99 |

(Continued)

*Primary Examiner* — Neel Girish Patel

(74) *Attorney, Agent, or Firm* — Patterson + Sheridan, LLP

(57) ABSTRACT

A downhole magnetic tool for use in a wellbore includes a mandrel and a magnet assembly coupled to the mandrel. The magnet assembly includes a magnet retainer having a chamber and a magnet disposed in the chamber. A bracket is used to retain the magnet in the chamber. The magnet assembly also includes one or more apertures configured to engage a magnet removal tool.

15 Claims, 11 Drawing Sheets

(56) References Cited

U.S. PATENT DOCUMENTS

| | | | | |
|---|---|---|---|---|
| 2008/0196881 | A1* | 8/2008 | Telfer | E21B 37/00 166/70 |
| 2010/0181064 | A1* | 7/2010 | Knobloch | E21B 17/1057 166/99 |
| 2012/0138289 | A1* | 6/2012 | Begley | E21B 17/1042 166/241.6 |
| 2013/0160993 | A1* | 6/2013 | Davila | E21B 17/10 285/333 |
| 2014/0000900 | A1* | 1/2014 | Leiper | E21B 17/1078 166/173 |
| 2014/0096972 | A1* | 4/2014 | Leiper | E21B 37/00 166/66.5 |
| 2016/0265325 | A1* | 9/2016 | Sharma | E21B 37/00 |
| 2017/0247980 | A1* | 8/2017 | Linklater | E21B 37/00 |
| 2021/0285301 | A1* | 9/2021 | Maher | H01F 7/0257 |
| 2021/0372220 | A1* | 12/2021 | Garcia | H01F 7/0257 |
| 2023/0250709 | A1* | 8/2023 | Leiper | E21B 37/00 166/311 |
| 2024/0076957 | A1* | 3/2024 | Leiper | E21B 31/06 |

* cited by examiner

WELLBORE CLEANING TOOLS

CROSS-REFERENCE TO RELATED APPLICATIONS

This application claims benefit of U.S. Provisional Patent Application Ser. No. 62/594,893, filed on Oct. 31, 2023, which is incorporated herein by reference in its entirety.

BACKGROUND

Field

Embodiments of the present disclosure generally relate to improvements for a wellbore cleaning tool.

Description of the Related Art

During formation of a wellbore, wellbore cleaning is performed to maintain wellbore operations such as drilling operations and production operations. Debris left in a wellbore can interfere with efficiency and may cause damage to the well or the downhole equipment. Therefore, a thorough wellbore cleaning is recommended during a wellbore operation or before next operation begins.

The debris can be cleaned out using a variety of methods or tools. One way of removing the debris involves using a wellbore cleaning tool equipped with magnets. The magnets attract the debris to the cleaning tool, and the debris is removed when the cleaning tool is retrieved.

One problem encountered with the magnetic cleaning tools is the corrosive conditions downhole. Often, the corrosive conditions downhole may damage the magnets, and in some instances, cause the magnets to separate from the cleaning tool. As a result, the damage to the magnets will negatively affect the performance of the wellbore cleaning tool.

There is, therefore, a need for improved wellbore cleaning tools.

SUMMARY

In one embodiment, a downhole magnetic tool for use in a wellbore includes a mandrel and a magnet assembly coupled to the mandrel. The magnet assembly includes a magnet retainer having a chamber and a magnet disposed in the chamber. A bracket is used to retain the magnet in the chamber. The magnet assembly also includes one or more apertures configured to engage a magnet removal tool.

In another embodiment, a downhole tool includes a mandrel having one or more key recesses and a centralizer disposed around the mandrel. The downhole tool also includes a bearing disposed between the mandrel and the centralizer. In one example, the bearing has a tubular body having a first outer portion having a first outer diameter and a second outer portion having a smaller, second outer diameter. The bearing also has one or more keys protruding from an inner surface of the tubular body. The one or more keys are configured to engage with the one or more key recesses.

In another embodiment, a downhole tool includes a mandrel, a centralizer disposed around the mandrel, and a bearing disposed between the mandrel and the centralizer. The tool also includes a magnet assembly coupled to the mandrel. The magnet assembly includes a magnet retainer having a chamber; a magnet disposed in the chamber; and a bracket for retaining the magnet in the chamber.

BRIEF DESCRIPTION OF THE DRAWINGS

Implementations of the present disclosure, briefly summarized above and discussed in greater detail below, can be understood by reference to the illustrative implementations of the disclosure depicted in the appended drawings. It is to be noted, however, that the appended drawings illustrate only typical implementations of this disclosure and are therefore not to be considered limiting of its scope, for the disclosure may admit to other equally effective implementations

DETAILED DESCRIPTION

This disclosure describes improvements for a downhole cleaning tool that increase the lifespan of the cleaning tool and its components. In one example, the improvements prolong the use of the magnets and the bearing in the downhole cleaning tool. In another example, the improvements facilitate the installation and removal of the magnet assembly.

Figure 1:
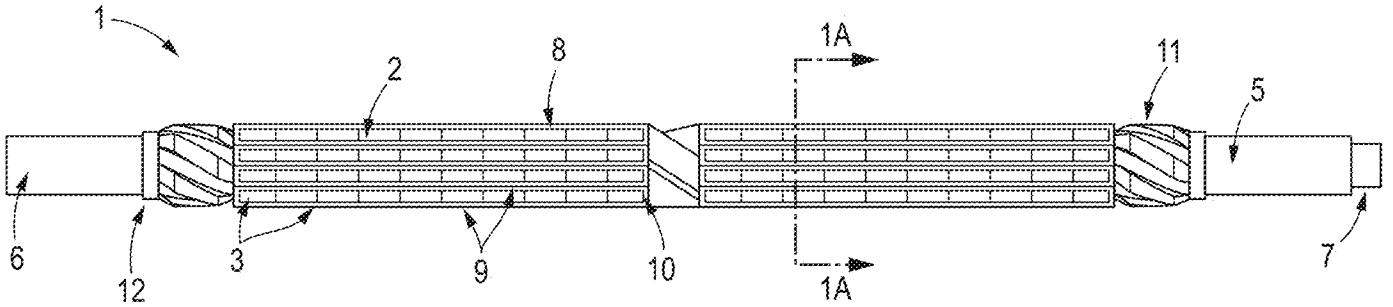
FIG. 1 illustrates a downhole cleaning tool, according to certain embodiments.
Figure 1B:
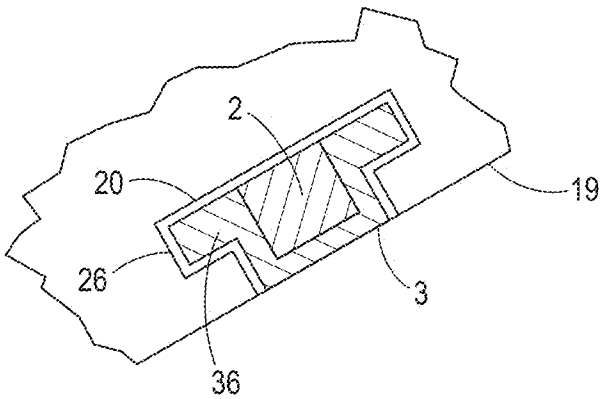
FIG. 1B illustrates an enlarged, partial view of FIG. 1A, according to certain embodiments.
Figure 1A:
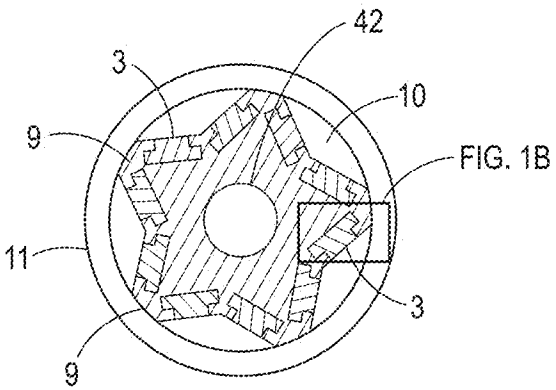
FIG. 1A illustrates a cross-sectional view taken along line 1A-1A in FIG. 1, according to certain embodiments.

FIG. 1 illustrates a downhole cleaning tool 1 having at least one magnet assembly 3, according to some embodiments of the present disclosure. FIG. 1A is a cross-sectional view of the cleaning tool 1 along line 1A-1A of FIG. 1. FIG. 1B is an enlarged partial view of FIG. 1A. It should be understood that the cleaning tool 1 may comprise any combination of the various elements described herein.

In one embodiment, the cleaning tool 1 includes a cylindrical mandrel 5 having an axial bore 42 extending therethrough and an appropriate box connector 6 at one end and an appropriate pin connector 7 at an opposite end to allow for connection to a downhole tool assembly, such as a drilling tool assembly or a conveyance string (not pictured). The mandrel 5 includes an outward surface 8 having a plurality of ribs 9 circumferentially spaced around the outward surface 8. A recess 10 is formed between two adjacent ribs 9 to facilitate the flow of wellbore fluid around and/or past the cleaning tool 1. The cleaning tool 1 includes two centralizers 11 disposed at each end of the ribs 9. A lock ring 12 is provided to retain the centralizers 11 and/or the magnet assemblies 3 in position on the mandrel 5. It is contemplated the cleaning tool 1 may have one or more centralizers 11. It is also contemplated other suitable locking mechanism may be used to retain the centralizers 11 and/or the magnet assemblies 3.

Figure 2A:
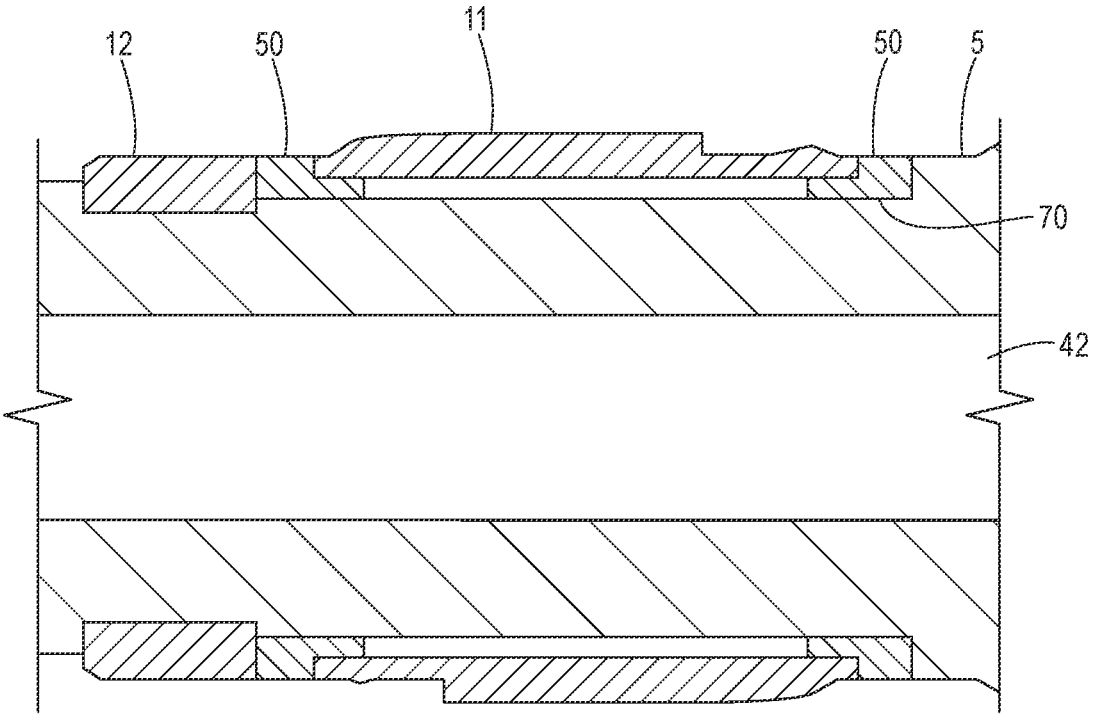
FIG. 2A is a partial cross-sectional view of a centralizer and a bearing disposed on the mandrel of the cleaning tool of FIG. 1.
Figure 2B:
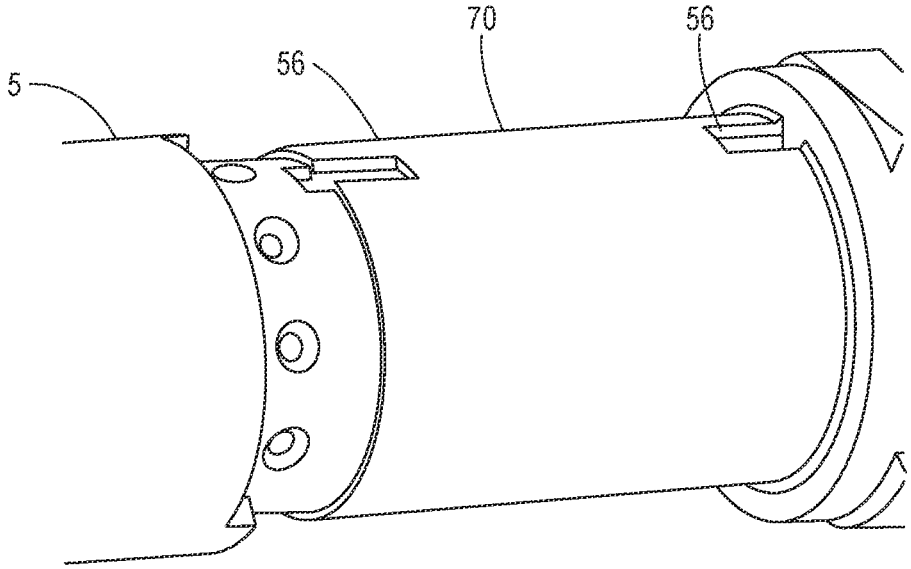
FIG. 2B is a partial, perspective view of the mandrel of the cleaning tool of FIG. 1 without the centralizer and the bearing.
Figure 2C:
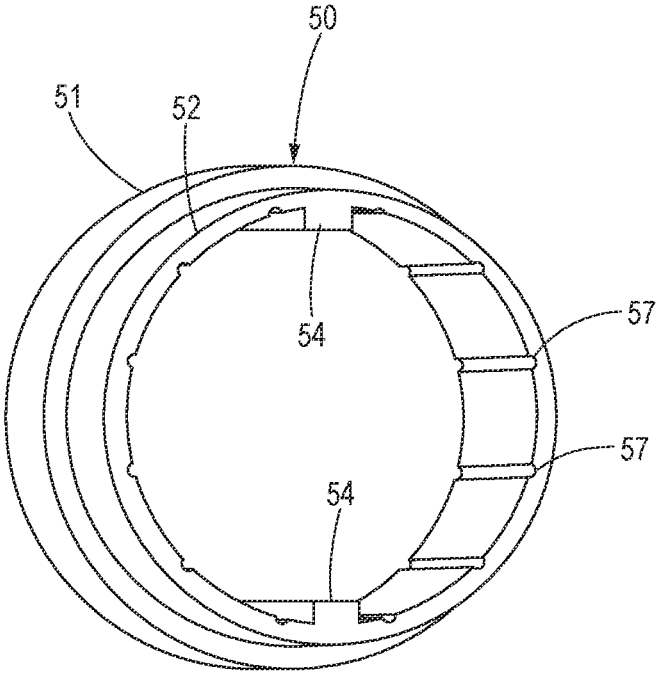
FIG. 2C illustrates an exemplary embodiment of the bearing shown in FIG. 2A.

FIG. 2A is a partial cross-sectional view of the centralizer 11 and the bearing 50 disposed on the mandrel 5 of the cleaning tool 1. FIG. 2B shows the mandrel 5 of the cleaning tool 1 without the centralizer 11 and the bearing 50. FIG. 2C illustrates an exemplary embodiment of a bearing 50 for coupling the centralizer 11 to the mandrel 5. As shown, two bearings 50 are used to support the opposite ends of the centralizer 11 on the mandrel 5. The bearings 50 are disposed on a recessed groove 70 formed in the mandrel 5. The groove 70 has a smaller diameter than the outer diameter of the mandrel 5. Each end of the centralizers 11 is supported by a bearing 50. In this respect, the inner diameter of the centralizer 11 does not contact the outer surface of the recessed groove 70.

In one embodiment, the bearing 50 has a tubular shape and may be split into two semicircular structures to facilitate installation on the mandrel 5. One or more keys 54 protrude inwardly from the inner diameter of the bearing 50. The key 54 is configured to mate with a key recess 56 formed in the mandrel 5. In some examples, the key recess 56 is longer than the key 54 to allow the bearing 50 to move axially during installation. The interaction between the key 54 and the key recess 56 prevents the bearings 50 from rotating relative to the mandrel 5. In some examples, one or more flutes 57 are formed on the inner dimeter of the bearings 50 and extend from one end to the opposite end of the bearing 50. The flutes 57 allow the fluid under the centralizer 11 to flow away from the centralizer 11.

The bearing 50 includes a first outer portion 51 having a first outer diameter and a second outer portion 52 having a smaller, second outer diameter. The ends of the centralizer 11 are supported on the second outer portion 52, and the centralizer 11 is rotatable relative to the second outer portion 52. The larger, first outer portion 51 limits axial movement of the centralizer 11 relative to the mandrel 5 and, in some instances, abuts the end of the centralizer 11. In turn, the lock ring 12 limits axial movement of the bearing 50 relative to the mandrel 5. The lock ring 12 may be attached to the mandrel 5 using any suitable attachment mechanism, such as fasteners (e.g., screw or bolt) or adhesives.

Referring back to FIG. 1, the ribs 9 are configured to support a plurality of magnet assemblies 3. In this example, the ribs 9 have two sidewalls 19 configured to retain one or more magnet assemblies 3. The sidewalls 19 include a retention slot 20 formed therein, as seen in FIG. 1B. The retention slots 20 are sized to be able to securely retain the magnet assemblies 3 on the cleaning tool 1. In this example, the slots 20 include grooves 26 for mating with the splines 36 on the magnet assemblies 3. The interaction between the splines 36 and grooves 26 prevents the magnet assemblies 3 from detaching from the ribs 9, while allowing axial movement of the magnet assemblies 3 along slots 20 in the ribs 9. In some examples, the magnet assemblies 3 may be coupled to the retention slots 20 using any suitable mechanism, including welding, fasteners, adhesives, or any other suitable connection mechanism. The positioning of the plurality of ribs 9 allows for the plurality of magnets 2 to come into contact with wellbore fluid as the fluid flows along the cleaning tool 1. As the wellbore fluid flows along the cleaning tool 1, the magnets 2 will attract debris in the fluid to allow for easy removal of debris.

Figure 3A:
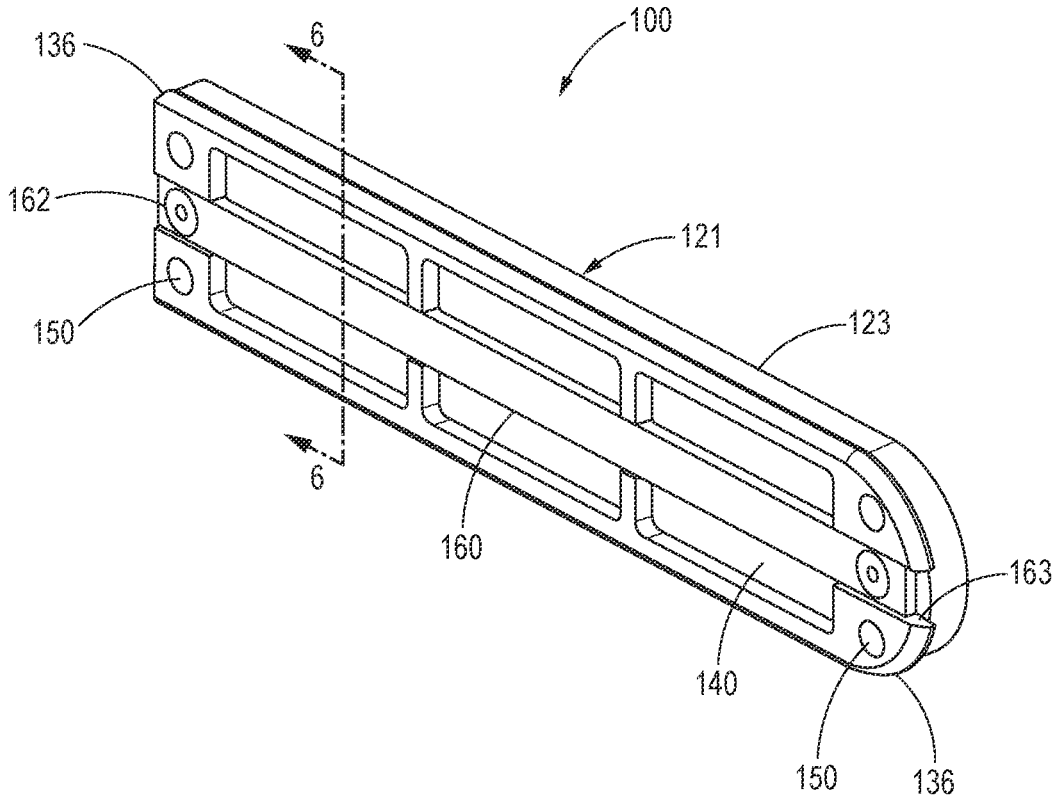
FIG. 3A illustrates an exemplary magnet assembly, according to certain embodiments.
Figure 3B:
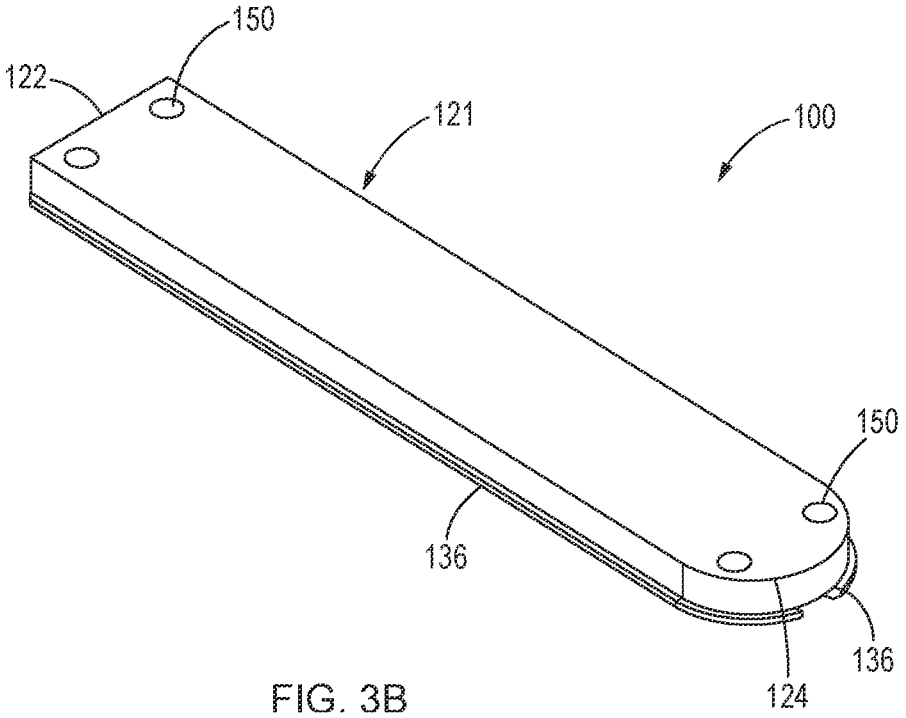
FIG. 3B is a top view of the magnet assembly of FIG. 3A.
Figure 3C:
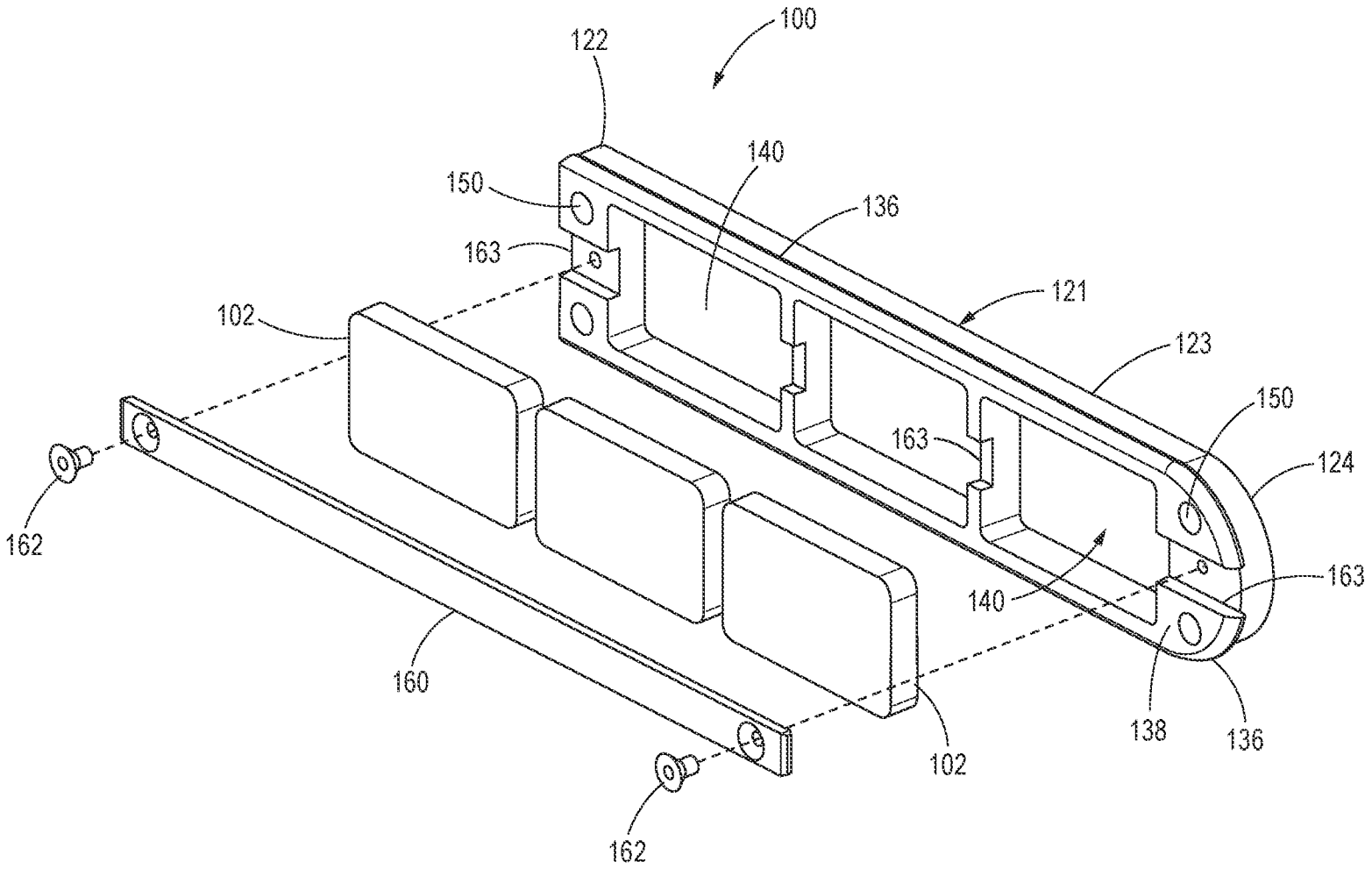
FIG. 3C is an exploded view of the magnet assembly of FIG. 3A.

FIG. 3A is a bottom view of an exemplary embodiment of a magnet assembly 100. The magnet assembly 100 may be used as the magnet assembly 3 of the cleaning tool 1 shown in FIG. 1. FIG. 3B is a top view of the magnet assembly 100, and FIG. 3C is an exploded view of the magnet assembly 100. The magnet assembly 100 includes a magnet retainer 121 for housing one or more magnets 102. The magnet retainer 121 has a generally rectangular body 123. In this example, one end 124 of the body 123 has an arcuate shape that corresponds to the arcuate shape of the end of the slot 20 in the rib 9. In this respect, this magnet assembly 100 may be used as an end magnet assembly 100. However, it is contemplated this end 124 of the magnet assembly 100 may have a square shape or other suitable shapes that correspond to the end of the slot 20, the opposite end 122 of the body 123, or an end of an adjacent magnet assembly 100. In some embodiments, the magnets 102 are rare earth magnets. The magnet retainer 121 may be comprised of a nonreactive material such as polymer, ceramic, or a metal alloy. For example, the magnet retainer 121 can be made from austenitic stainless steel, such as 300 series stainless steel.

The magnet retainer 121 includes a spline 136 formed at a lower portion of the body 123. The spline 136 protrudes from the sides of the body 123. In this example, the spline 136 is also formed at the arcuate end 124 for engaging the groove 26 at the end of the slot 20. In some embodiments, the spline 136 is optional at the opposite end 122. When the spline 136 is not present, two adjacent magnet assemblies 100 may be located closer to each other. In some embodiments, the opposite end 122 includes the spline 136, and the end of the adjacent magnet assembly can include a groove 26 for mating with the spline 136. In one embodiment, the spline 136 has a trapezoidal profile. In some embodiments, the spline 136 may have other suitable profiles, such as a square profile or an arcuate profile.

Figure 4:
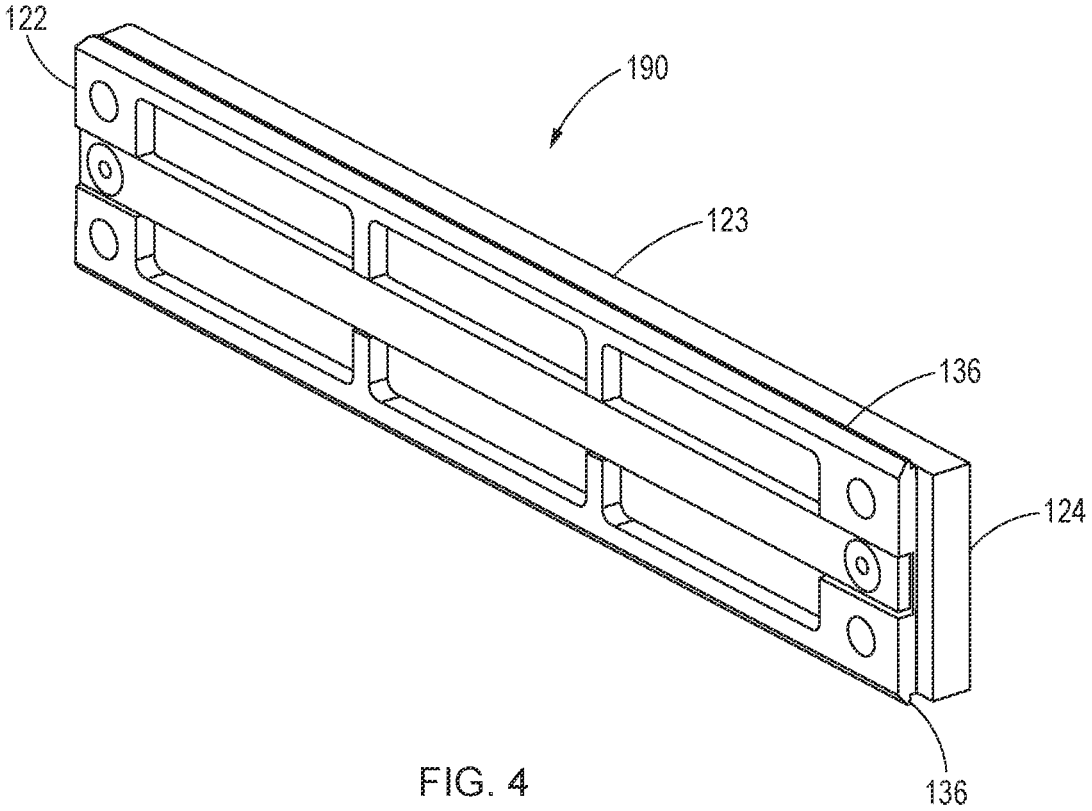
FIG. 4 illustrates another embodiment of a magnet assembly.

FIG. 4 shows an exemplary magnet assembly 190 having a square shape at both ends 122, 124. This magnet assembly 190 may be used as an intermediate magnet assembly 190 that is positioned between the two ends of the slot 20, but it may also be used at either end of the slot 20. In this example, the spline 136 is formed on the sides of the body 123, but not at the ends 122, 124 of the body 123.

Referring back to FIGS. 3A-3C, the body 123 includes one or more chambers 140 for housing one or more magnets 102. Although three chambers 140 are provided in this example, the body 123 may include any suitable number of chambers 140, such as one, two, four or more chambers. The chambers 140 may have any suitable shape for housing the magnets 102. In some examples, the shape of the chambers 140 corresponds to the shape of the magnets 102.

The body 123 includes one or more apertures 150 for mating with a magnet removal tool. In this respect, a removal force applied by the magnet removal tool may be transferred to the magnet assembly 100. In this example, the body 123 includes four apertures 150 positioned at the two ends 122, 124. In some examples, the apertures 150 are axially spaced away from the chambers 140. However, any suitable number of apertures 150 may be provided, such as one, two, three, five or more apertures. In one example, the number of apertures 150 is sufficient for the removal tool to transfer a sufficient amount of force to move the magnet assembly 100 relative to the slot 20. As shown, the apertures 150 have a circular cross-section. In some examples, the apertures 150 have a polygonal or non-polygonal cross-section, including square, rectangle, or oval. In this example, the apertures 150 are formed through the body 123. It is contemplated the apertures 150 may be formed partially into the body 123. The apertures 150 may also be positioned any suitable location, for example, three apertures 150 may be spaced lengthwise on the body 123.

The magnet assembly 100 may optionally include one or more brackets 160 to retain the magnets 102 in the chambers 140. In the example shown in FIGS. 3A-C, the bracket 160 extends across all three magnets 102. A fastener 162, such as a screw, is used to attach each end of the bracket to the body 123. In this example, the bracket 160 is disposed in recesses 163 formed in the body 123 such that the bracket 160 does not extend out of the bottom surface 138 of the body 123. Suitable shapes of the brackets 160 include a rectangular prism, cylindrical rod, a wire, and a plate. In some examples, a plurality of brackets 160 are attached along the length of the body 123, the width of the body 123, or both. The brackets 160 can be attached using a fastener, interference fit, or adhesives. The magnet assemblies 100 can be pre-assembled prior to insertion into the slots 20. The brackets 160 may advantageously improve the retention of the magnets 102 in the magnet assembly 100. Additionally, the brackets 160 can facilitate installation and removal of the magnets 102 from the chambers 140 of the magnet retainer 121.

Figure 5A:
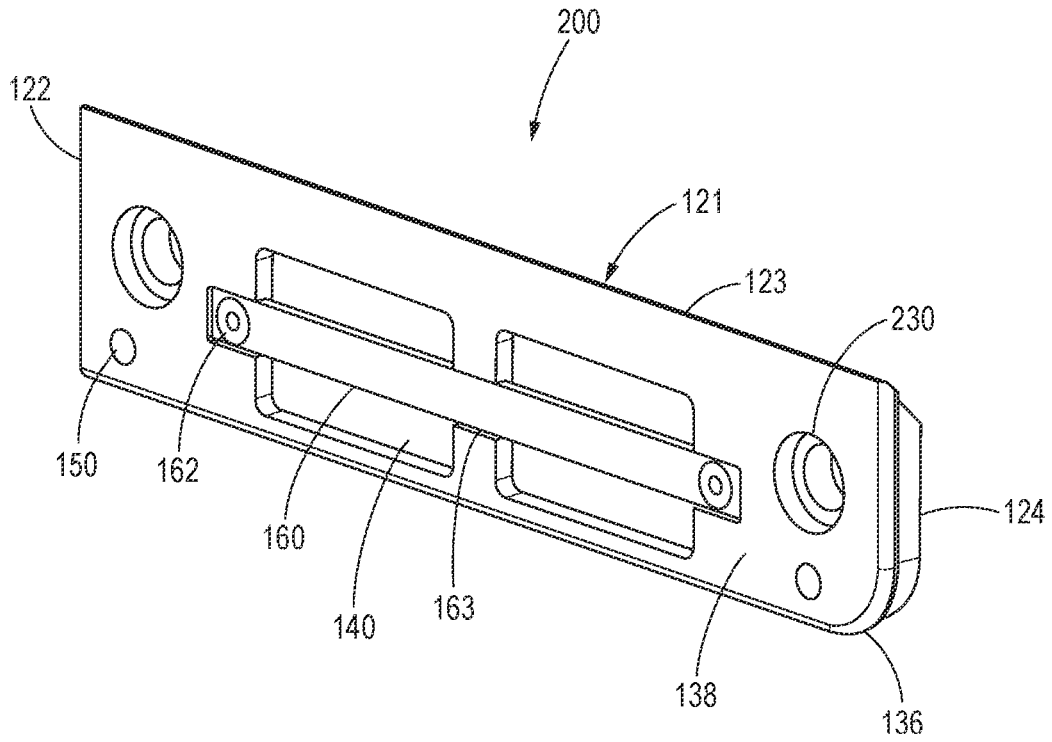
FIG. 5A illustrates another embodiment of a magnet assembly.
Figure 5B:
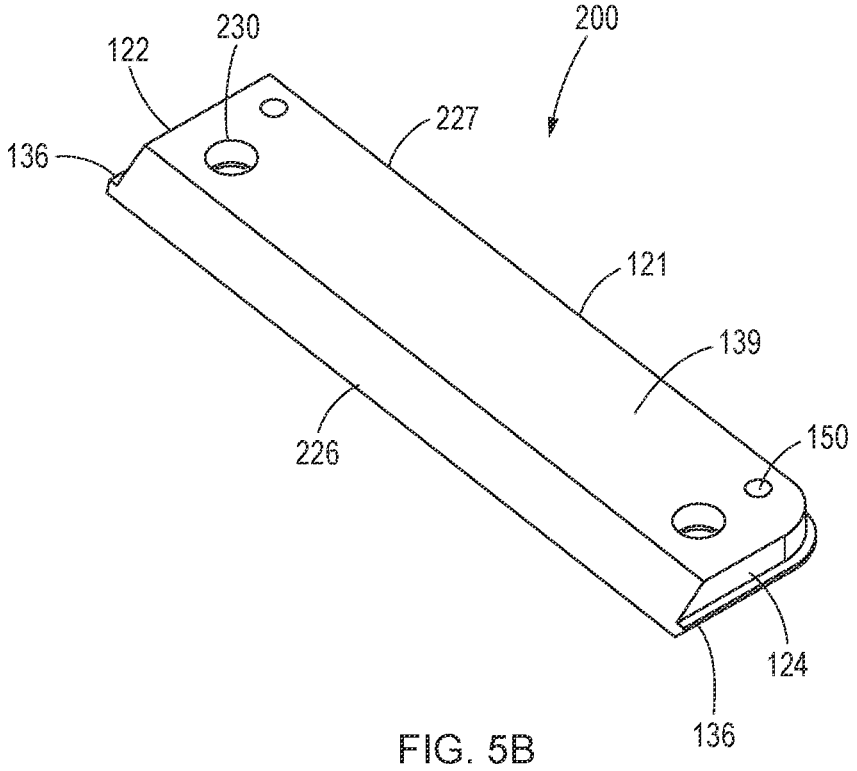
FIG. 5B is a top view of the magnet assembly of FIG. 5A.
Figure 5C:
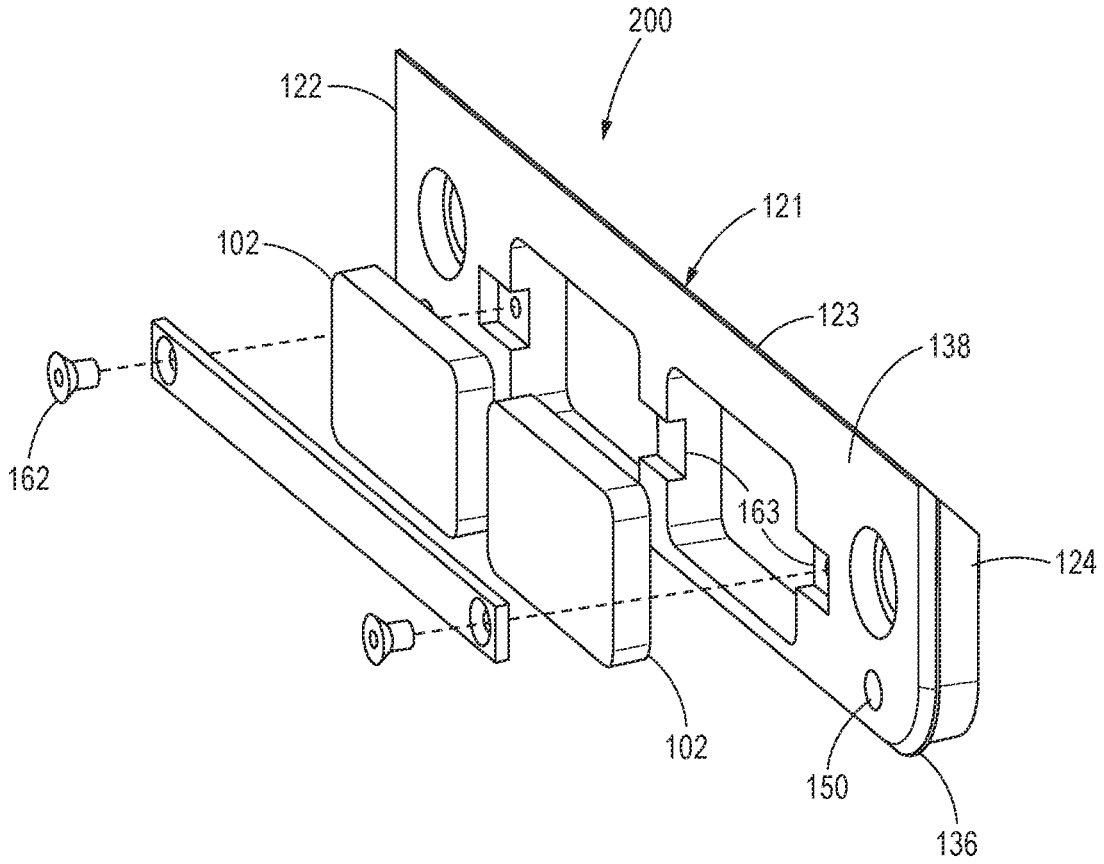
FIG. 5C is an exploded view of the magnet assembly of FIG. 5A.

FIG. 5A is a bottom view of another exemplary embodiment of a magnet assembly 200. The magnet assembly 200 may be used as the magnet assembly 3 of the cleaning tool 1 shown in FIG. 1. FIG. 5B is a top view of the magnet assembly 200, and FIG. 5C is an exploded view of the magnet assembly 200. The magnet assembly 200 is similar to the magnet assembly 100 of FIG. 2A, and, for sake of clarity, like features will not be further described in detail.

The magnet assembly 200 includes a magnet retainer 121 for housing one or more magnets 102. The magnet retainer 121 has a generally rectangular body 123 and rectangular ends 122, 124. In this example, one side 226 of the body 123 has an optional incline relative to the axis perpendicular to the bottom surface 138 of the body 123. The side 226 is inclined such that the side 226 faces upward. The incline surface 226 beneficially reduces the impact of the magnet assembly 200 contacting an object, such as debris, during rotation.

The magnet retainer 121 includes a spline 136 formed at a lower portion of the body 123. The spline 136 protrudes from the ends 122, 124 and the side 227 opposite the inclined side 226. In this example, the spline 136 is not formed at the inclined side 226 of the body 123. The spline 136 has a trapezoidal profile, but may have any other suitable profile. The body 123 includes two chambers 140 for housing the magnets 102. The chambers 140 have a rectangular shape to accommodate the rectangular shaped magnets 102.

In this example, the body 123 also includes two apertures 150 for mating with a magnet removal tool. One aperture 150 is positioned at each of the ends 122, 124. A removal force applied by the removal tool may be transferred to the body 123 via the apertures 150. As shown, the apertures 150 have a circular cross-section and formed through the body 123.

The magnet assembly 200 may optionally include one or more brackets 160 to retain the magnets 102 in the chambers 140. In this example, the bracket 160 extends across both magnets 102. A fastener 162, such as a screw, is used to attach each end of the bracket to the body 123. The bracket 160 is disposed in recesses 163 formed in the body 123 such that the bracket 160 does not extend out of the bottom surface of the body 123.

In one embodiment, the magnet assembly 200 is positioned at the open end of the slot 20 to prevent the magnet assemblies (e.g., magnet assemblies 100, 190) in the slot 20 from moving out of the slot 20. In some examples, the magnet assembly 200 is positioned at least partially in the slot 20. In some examples, the magnet assembly 200 is positioned outside of the slot 20, but at a location that prevents the interior magnet assemblies 100, 190 from moving out of the slot 20.

In one embodiment, the body 223 includes an opening 230 for mating with a fastener in the mandrel 5. In this example, the fastener, such as a screw, may initially be positioned in the mandrel 5 and at or below the surface of the mandrel 5. After the interior magnet assemblies 100, 190 have been inserted into the slot 20, the magnet assembly 200 is positioned at least partially in the slot 20 to retain the interior magnet assemblies 100, 190 in the slot 20. The opening 230 is aligned with the screw in the mandrel 5, and then the screw is rotated so that the screw protrudes from the surface and into the opening 230. In this manner, the position of the magnet assembly 200 is fixed relative to the slot 20. It is contemplated the magnet assembly 200 may be fixed by inserting a screw from the top and into the mandrel. The magnet assembly 200 can also be fixed using other suitable mechanisms, such as interference fit, adhesives, or other suitable locking mechanisms.

In some embodiments, the magnet assemblies 100, 190, 200 can be configured such that the magnets 102 are facing outward. In this respect, the magnets 102 can come into contact with the wellbore fluid.

Figure 6:
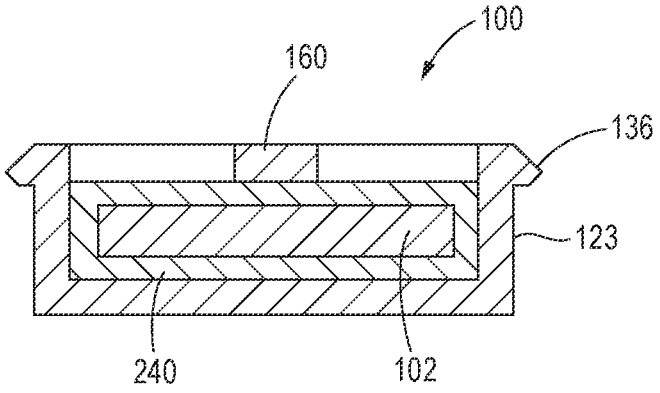
FIG. 6 is a cross-sectional view of another embodiment of a magnet assembly.
Figure 6A:
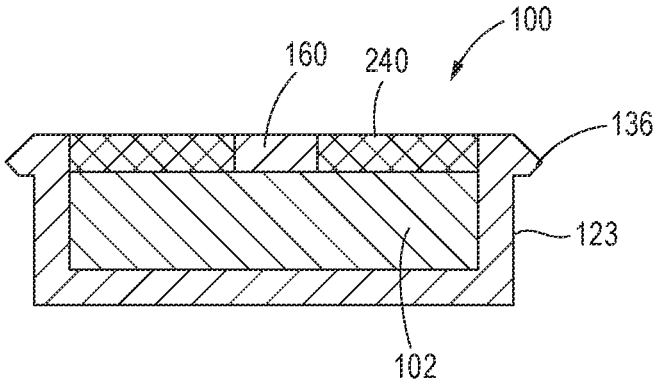
FIG. 6A is a cross-sectional view of another embodiment of a magnet assembly.

In some embodiments, the magnets 102 includes a coating disposed around its exterior. FIG. 6 is a cross-sectional view of the magnet assembly 100 of FIG. 3A along line 6-6, and the magnet 102 is provided with a coating 240. The coating 240 may provide protection from the corrosive environment downhole. The coating 240 may be comprised of a polymer, non-ferrous metal, or any other suitable nonmagnetic substance. In this example, the magnet 102 is completely surrounded by a coating 240 before being secured in the body 123 of the magnet retainer 121 using brackets 160. In some examples, the coating 240 can have a thickness from about 0.0001 inches to 0.1 inches, such as from 0.0005 inches to 0.05 or from 0.001 inches to 0.01 inches. In some embodiments, the coating 240 will at least partially cover the plurality of magnets 102 to protect the magnets 102 from the downhole environment, such as corrosive fluids, heat, and physical contact with objects. In another embodiment, the plurality of magnets 102 are placed in the magnet retainer 121 and secured using the bracket 160. Thereafter, a coating 240 is applied over an exposed portion of the plurality of magnets 102, as illustrated in FIG. 6A. In this example, the coating 240 covers the surfaces of the magnets not surrounded by the body 123 of the magnet retainer 121. In some embodiments, the magnet 102 is encapsulated in metal. In one example, the magnet 102 is disposed in an enclosure comprising an anti-corrosion sheet metal.

Figure 6B:
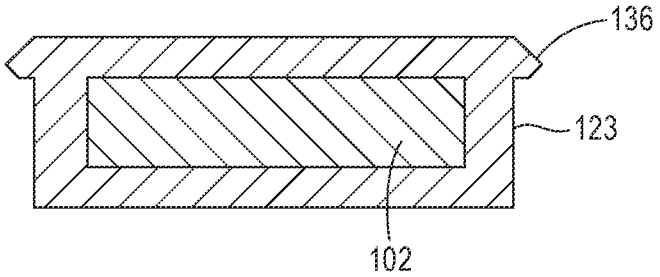
FIG. 6B is a cross-sectional view of another embodiment of a magnet assembly.

In another embodiment, the magnet retainer 321 is configured to surround the magnets 102, as illustrated in FIG. 6B. As shown, the magnet 102 is embedded in the body 323 of the magnet retainer 321. The body 323 may be made of non-ferrous metal, ceramic, polymer, or any other protective, nonmagnetic material. The body 323 is configured with splines 136 and shaped to slide or snap-fit into a retention slot 20. In this manner, the plurality of magnets 102 are secured and protected from the corrosive environment downhole.

Figure 7:
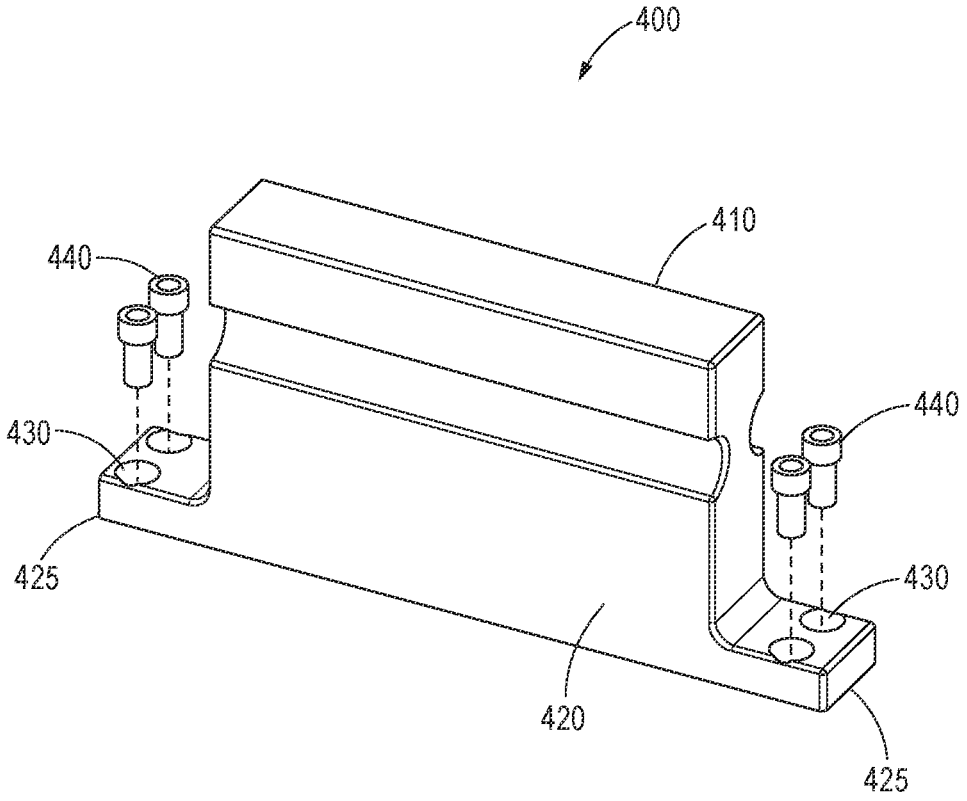
FIG. 7 illustrates an exemplary embodiment of a magnet removal tool.

FIG. 7 illustrates an exemplary magnet removal tool 400 suitable for removing the magnet assemblies 100, 190, 200 from the slots 20 of the cleaning tool 1. In one embodiment, the removal tool 400 includes a tool body 420 and a handle 410. The tool body 420 includes a shoulder 425 at each end that extends past the handle 410. The shoulders 425 include one or more apertures 430 for accommodating a connector 440. In this example, each shoulder 425 includes two apertures 430 that can be aligned with the apertures 150 on the magnet assembly 100. The connector 440 can be inserted into the aperture 430 such that the connector 440 is at least partially disposed in the aperture 430 of the removal tool 400 and the aperture 150 of the magnet assembly 100. Suitable connectors 440 include a screw, bolt, pin, or other connectors than can be positioned in both apertures 150, 430. Although four apertures 430 are shown, it is contemplated that four or less connectors 440 may be used to engage the magnet assembly 100. In another embodiment, the connector 440 may be attached to or integral with the removal tool 400. For example, the connector 440 may be a protrusion formed at the bottom surface of the removal tool 400. In some embodiments, the connectors 440 have sufficient length to engage the magnet assembly 100 when the removal tool is place above the magnet assembly 100 and not in direct contact with the magnet assembly 100. In some embodiments, the bottom portion of the tool body 420 has a width sized to fit in the opening of the slot 20 so that the bottom portion of the tool body 420 can contact the magnet assembly 100. The handle 410 may have any suitable shape so long as the handle 410 can be gripped to maneuver the magnet removal tool 400.

Figure 8A:
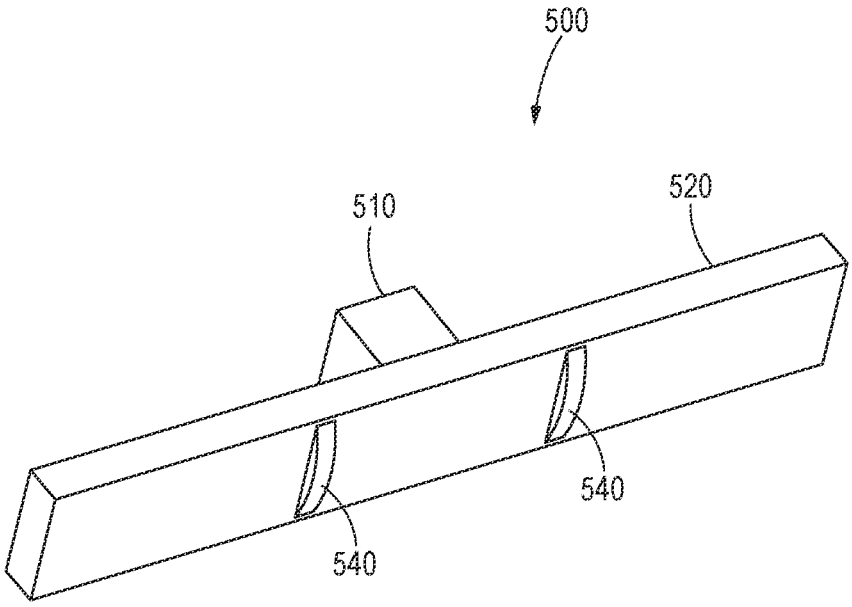
FIG. 8A illustrates an exemplary embodiment of a magnet removal tool.
Figure 8B:
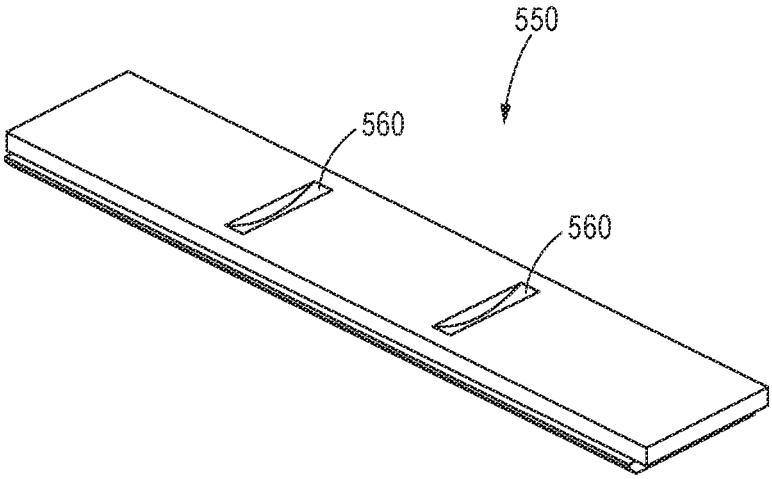
FIG. 8B is a top view of a magnet assembly configured to engage with the magnet removal tool of FIG. 8A.

FIG. 8A illustrates another embodiment of a magnet removal tool 500. FIG. 8B is a top view of a magnet assembly 550 configured to engage with the magnet removal tool 500. The magnet assembly 550 may be configured as any of the magnet assemblies 100, 190, 200 disclosed herein. The magnet removal tool 500 includes a tool body 520 and a handle 510. The handle 510 may have any suitable shape so long as the handle 510 can be gripped to maneuver the magnet removal tool 500.

The bottom surface of the tool body 520 includes one or more connectors 540 formed thereon. In this example, the connectors 540 are integral with the tool body 520 and protrude from the bottom surface of the tool body 520. The connectors 540 have an arcuate shape, but may have any suitable shape for engaging the magnet assembly 550. As shown in FIG. 8B, the top surface of the magnet assembly 550 includes a recess having an arcuate shape that corresponds to the arcuate shape of the magnet removal tool 500. Although two connectors 540 are shown, the magnet removal tool 500 may have any suitable number of connectors 540, and the connectors may have the same or different shapes.

Embodiments of the present disclosure provides a downhole cleaning tool having features that protect and stabilize the magnets in the corrosive environment downhole, thereby increasing the lifespan of the magnets and of the downhole cleaning tool.

In various embodiments, the present disclosure provides downhole tools having improved retention of the magnets coupled to a mandrel of the tool. In some embodiments, the magnets are retained using a bracket. In other embodiments, the magnets are held by a coating, such as an epoxy. These features ensure that the magnets are held in place, but also allow the magnets to be removed for inspection, repair, and/or replacement.

In one embodiment, a downhole magnetic tool for use in a wellbore includes a mandrel and a magnet assembly coupled to the mandrel. The magnet assembly includes a magnet retainer having a chamber and a magnet disposed in the chamber. A bracket is used to retain the magnet in the chamber. The magnet assembly also includes one or more apertures configured to engage a magnet removal tool.

In another embodiment, a downhole tool includes a mandrel having one or more key recesses and a centralizer disposed around the mandrel. The downhole tool also includes a bearing disposed between the mandrel and the centralizer. In one example, the bearing has a tubular body having a first outer portion having a first outer diameter and a second outer portion having a smaller, second outer diameter. The bearing also has one or more keys protruding from an inner surface of the tubular body. The one or more keys are configured to engage with the one or more key recesses.

In another embodiment, a downhole tool includes a mandrel, a centralizer disposed around the mandrel, and a bearing disposed between the mandrel and the centralizer. The tool also includes a magnet assembly coupled to the mandrel. The magnet assembly includes a magnet retainer having a chamber; a magnet disposed in the chamber; and a bracket for retaining the magnet in the chamber.

In one or more of the embodiments described herein, the mandrel includes a slot, and the magnet assembly is at least partially disposed in the slot.

In one or more of the embodiments described herein, the slot includes a groove, and the magnet retainer includes a spline for engaging the groove in the slot.

In one or more of the embodiments described herein, the bracket is at least partially disposed in a recess formed in the magnet retainer.

In one or more of the embodiments described herein, the magnet comprises rare earth metals.

In one or more of the embodiments described herein, the magnet retainer comprises a nonmagnetic material.

In one or more of the embodiments described herein, the tool includes a coating disposed around the magnet.

In one or more of the embodiments described herein, the coating comprises a polymer, non-ferrous metal, a nonmagnetic material, or combinations thereof.

In one or more of the embodiments described herein, the one or more apertures are axially spaced away from the chamber.

In one or more of the embodiments described herein, the one or more apertures are formed on a top surface of the magnet retainer, and the top surface covers the magnet.

In one or more of the embodiments described herein, the centralizer is supported on the second outer portion.

In one or more of the embodiments described herein, the bearing is disposed in a groove formed in the mandrel, and the one or more key recesses are formed in the groove.

In one or more of the embodiments described herein, the bearing is rotationally fixed relative to the mandrel when the one or more keys are engaged with the one or more key recesses.

In one or more of the embodiments described herein, the tool comprises two bearings for supporting the centralizer.

In one or more of the embodiments described herein, the tool includes one or more apertures configured to engage a magnet removal tool.

In one or more of the embodiments described herein, the bearing comprises one or more keys protruding from an inner surface of the tubular body, the one or more keys configured to engage with the one or more key recesses.

In one or more of the embodiments described herein, the bearing comprises a tubular body having a first outer portion having a first outer diameter and a second outer portion having a smaller, second outer diameter, and wherein the centralizer is supported on the second outer portion.

In one or more of the embodiments described herein, the tool includes a magnet removal tool configured to engage the magnet retainer.

In one or more of the embodiments described herein, the magnet removal tool includes one or more connectors for engaging one or more apertures of the magnet assembly.

In one or more of the embodiments described herein, the one or more connectors are removable from the magnet removal tool.

In one or more of the embodiments described herein, the one or more connectors are integral with the magnet removal tool.

In one or more of the embodiments described herein, the magnets are encapsulated in a metal sheet.

While the foregoing is directed to implementation of the present disclosure, other and further implementations of the disclosure may be devised without departing from the basic scope thereof.

What is claimed is:

1. A downhole magnetic tool for use in a wellbore, the tool comprising:

a mandrel including a slot having a groove; and a plurality of magnet assemblies coupled to the mandrel, each magnet assembly having:

a magnet retainer having a chamber and a spline for engaging the groove, whereby the magnet assembly is movably coupled to the mandrel;

a magnet disposed in the chamber;

a bracket for retaining the magnet in the chamber; and one or more apertures configured to engage a magnet removal tool.

2. The tool of claim 1, wherein the bracket is at least partially disposed in a recess formed in the magnet retainer.

3. The tool of claim 1, wherein the magnet comprises rare earth metals.

4. The tool of claim 1, wherein the magnet retainer comprises a nonmagnetic material.

5. The tool of claim 1, further comprising a coating disposed around the magnet.

6. The tool of claim 5, wherein the coating comprises a polymer, non-ferrous metal, a nonmagnetic material, or combinations thereof.

7. The tool of claim 1, wherein the one or more apertures are axially spaced away from the chamber.

8. The tool of claim 1, wherein the one or more apertures are formed on a top surface of the magnet retainer, and the top surface covers the magnet.

9. The tool of claim 1, wherein the magnet retainer includes a bottom surface for contacting the mandrel and a top surface that covers the magnet.

10. The tool of claim 1, wherein the mandrel includes a plurality of ribs circumferentially spaced around the mandrel, and the slot is formed in a sidewall of the plurality of ribs.

11. The tool of claim 1, wherein the magnet is at least partially disposed in the slot of the mandrel.

12. The tool of claim 1, wherein the mandrel includes a plurality of slots, wherein each slot includes a groove for receiving the spline of at least one magnet assembly of the plurality of magnet assemblies.

13. A downhole magnetic tool for use in a wellbore, the tool comprising:

a mandrel including a slot having a groove; and a magnet assembly coupled to the mandrel, the magnet assembly having:

a magnet retainer having a chamber and a spline for engaging the groove, whereby the magnet assembly is movably coupled to the mandrel;

a magnet disposed in the chamber and at least partially disposed in the slot; and a bracket for retaining the magnet in the chamber, wherein the bracket is at least partially disposed in a recess formed in the magnet retainer.

14. The tool of claim 13, further comprising a coating disposed around the magnet.

15. The tool of claim 13, wherein the magnet retainer includes a bottom surface for contacting the mandrel and a top surface that covers the magnet.

* * * * *